United States Patent [19]

Rudell et al.

[11] Patent Number: 5,052,973

[45] Date of Patent: Oct. 1, 1991

[54] TOY CAR LAUNCHER WITH CABLE DRIVEN SHUTTLE AND PULLEYS

[75] Inventors: Elliot A. Rudell, Rancho Palos Verdes; Joseph S. Cernansky; Roger J. Gardner, Jr., both of Lomita, all of Calif.; Steven J. Huebl, Minnetonka, Minn.; Robert D. Zera, Minnetonka, Minn.; Eugene J. Kilroy, Minnetonka, Minn.; Richard S. Chang, Rolling Hills Estates, Calif.

[73] Assignee: Tonka Corporation, Louis Park, Minn.

[21] Appl. No.: 624,650

[22] Filed: Dec. 10, 1990

[51] Int. Cl.[5] ..... A63H 29/00; A63H 27/14; A63H 27/00; F41B 15/00

[52] U.S. Cl. ..... 446/429; 446/489; 446/65; 446/45; 124/17; 124/79

[58] Field of Search ..... 446/429, 430, 435, 399, 446/473, 476, 487, 489, 490, 63, 64, 65, 41, 45; 124/17, 79

[56] References Cited

U.S. PATENT DOCUMENTS

| | | | |
|---|---|---|---|
| 2,860,620 | 11/1958 | Effinger, Jr. | 446/63 X |
| 3,600,850 | 8/1971 | Summerfield et al. | 446/429 |
| 3,605,328 | 12/1969 | Kilroy, Jr. | 446/41 |
| 3,605,631 | 9/1971 | See et al. | 446/429 |
| 3,641,704 | 1/1972 | Sims et al. | 446/429 |
| 3,735,526 | 5/1973 | Ensmann et al. | 446/429 |
| 3,797,164 | 3/1974 | Glass et al. | 446/429 X |
| 3,905,350 | 9/1975 | Becker | 446/430 X |
| 3,952,442 | 4/1976 | Livesey et al. | 446/429 |
| 4,238,093 | 12/1980 | Siegel et al. | 446/63 X |
| 4,418,495 | 12/1983 | Kennedy et al. | 446/429 |
| 4,423,871 | 1/1984 | Mucaro | 446/429 X |
| 4,433,504 | 2/1984 | Terui | 446/429 X |
| 4,472,906 | 9/1984 | Cook et al. | 446/429 |
| 4,483,096 | 11/1984 | Gabler et al. | 446/430 |
| 4,513,967 | 4/1985 | Halford et al. | 273/108 |
| 4,690,658 | 9/1987 | Cresson et al. | 446/429 |
| 4,889,512 | 12/1989 | Paddock | 446/72 |
| 4,946,417 | 8/1990 | Ishikawa et al. | 446/430 |

FOREIGN PATENT DOCUMENTS

| | | | |
|---|---|---|---|
| 2031426 | 1/1971 | Fed. Rep. of Germany | 446/430 |
| 2844036 | 4/1980 | Fed. Rep. of Germany | 446/63 |
| 1441055 | 6/1976 | United Kingdom | 446/430 |

*Primary Examiner*—Robert A. Hafer
*Assistant Examiner*—D. Neal Muir
*Attorney, Agent, or Firm*—Vidas & Arrett

[57] ABSTRACT

A toy car launcher includes a base which carries a combination of pulleys which cause a slide in an elongated track to be rapidly propelled down a track when a pair of handles are pulled. A car placed on the track is propelled by the slide down the track, gaining velocity until it exits the track and continues its travel. The track is hinged to ease transport and storage.

17 Claims, 5 Drawing Sheets

10
14
16
18
24
26
52
60
62
64
66
68
70
72
74
120
130
140
142
144

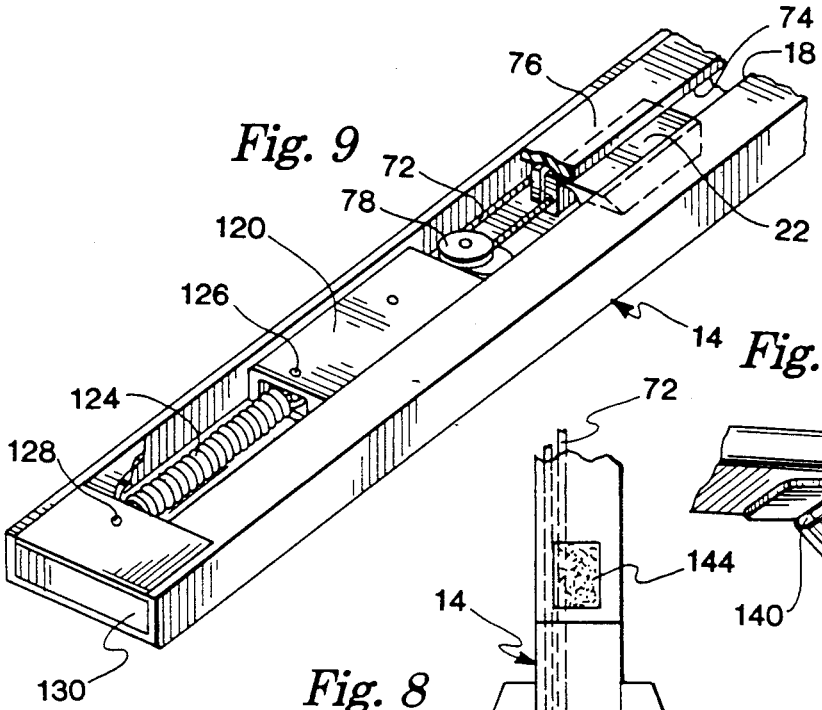
Fig. 9
Fig. 10
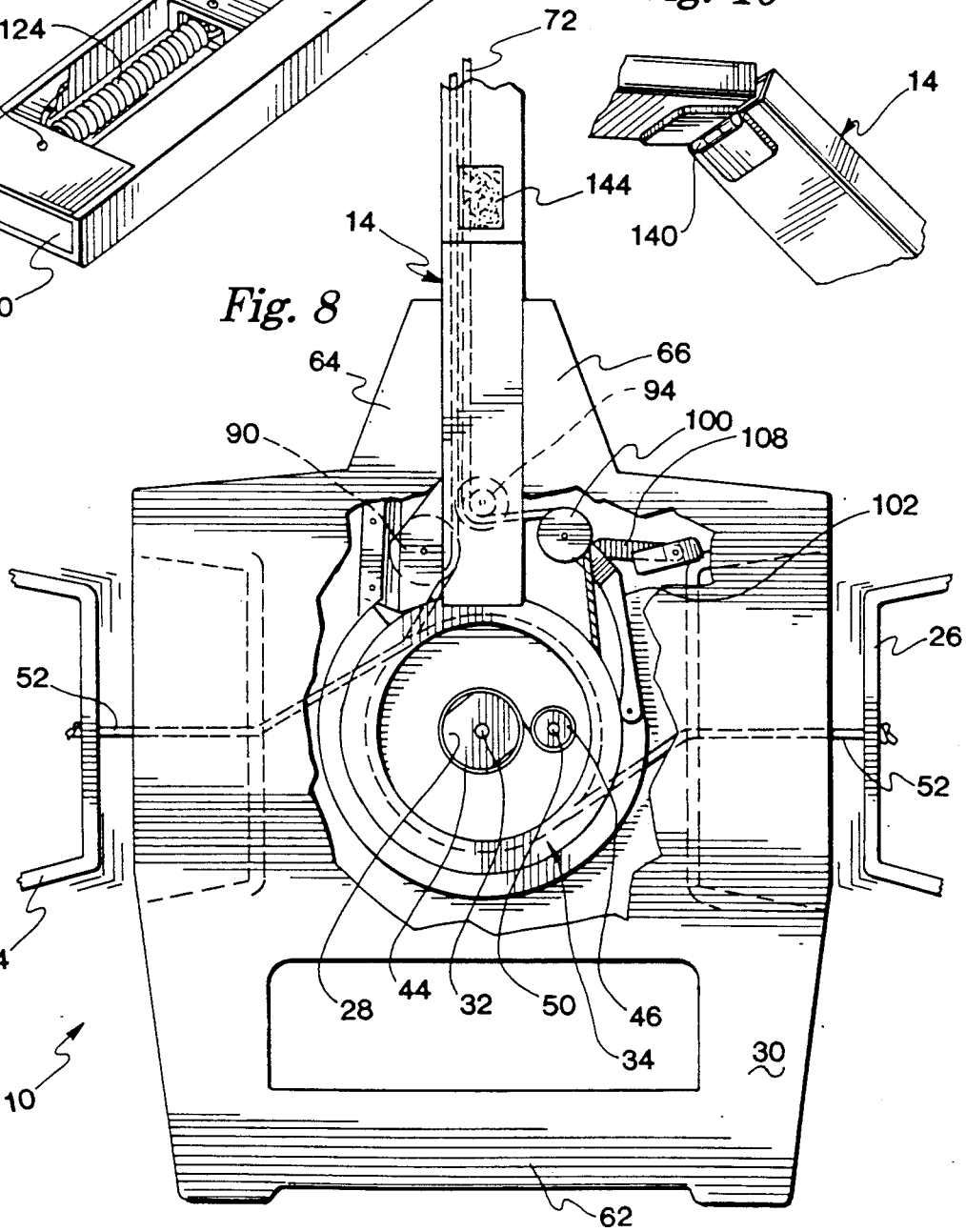
Fig. 8

TOY CAR LAUNCHER WITH CABLE DRIVEN SHUTTLE AND PULLEYS

BACKGROUND OF THE INVENTION

1. Field of the Invention

This invention relates to a toy car launcher which propels cars along a track. More particularly, the launcher includes an elongated track in which a slide mechanism which can engage a car is located. The slide is propelled rapidly down the track when a user pulls outwardly on two handles. Each handle is connected by cord to a drive pulley. That pulley is connected to the slide by a drive cord which causes the slide to move in response to a pull on the handles. A rewind spring resets the launcher for another launching. The pulley provides a mechanical advantage which allows the slide to rapidly accelerate a car down the track.

2. Description of the Related Art

U.S. Pat. No. 4,690,658, entitled "Toy Car Launcher with Expandable Scissors Members" issued Sept. 1, 1987 to Crosson et al, is directed to a vehicle launcher which employs expandable scissors members which lengthen when a handle is squeezed.

U.S. Pat. No. 3,641,704, entitled "Accelerator for a Vehicle Toy" issued Feb. 15, 1972 to Sims et al, is directed to a device that propels a car by gripping members which engage both sides of a vehicle. As a vehicle is squeezed through the device, it is accelerated.

U.S. Pat. No. 3,797,164, entitled "Toy Vehicle Launching Station" which issued Mar. 19, 1974 to Glass et al, is directed to a device that has spring-loaded plungers in slots which may be released to propel a car. Either rubber bands or springs are used to drive the plungers.

U.S. Pat. No. 3,952,442, which issued Apr. 27, 1976 to Livesey et al, is directed to a car launcher which is foot operated. Foot pressure squeezes and squirts a car forward out of the device. It requires a sloping ended car with a special construction.

U.S. Pat. No. 4,472,906, entitled "Manually Activated Toy Vehicle Launcher" which issued Sept. 25, 1984 to Cook et al, is directed to a launcher in which an upper casing is moved forward which causes a motion multiplier to increase the rate of movement of a lower ram. The ram contacts and drives the car. A gear train and track comprise the motion multiplier.

U.S. Pat. No. 4,513,967, entitled "Toy Vehicle Game with Launcher and Return Means" which issued Apr. 30, 1985 to Halford et al, is directed to a toy collision set that uses a launcher having a piston assembly with a 5-to-1 compression ratio. There is an elastic return means at the end of the track which returns the car toward the user if the cars have not already crashed. Downward actuation of the piston quickly extends a smaller horizontally extending piston which drives against a vehicle. A spring returns the piston to the ready-to-use position.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(*a*) exists.

SUMMARY OF THE INVENTION

The launcher of the invention includes an elongated track in which a slide mechanism is located. The slide is propelled rapidly down the track when a user pulls outwardly on two handles. Each handle is connected by cord to a drive pulley. That pulley is connected to the slide by a drive cord which causes the slide to move in response to a pull on the handles. The pulley provides a mechanical advantage which allows the slide to rapidly accelerate a car down the track.

In the preferred embodiment, a car or other vehicle to be propelled is placed on the track with a downwardly depending hook positioned against the slide. When the handles are pulled quickly to the outside, the slide mechanism is rapidly propelled down the track, pushing the car to the end of the track. At the track end, the car continues its forward travel at a rapid rate of speed.

The invention provides a vehicle launcher which accelerates a toy vehicle along an elongated track. The vehicle simply needs to engage with the slide mechanism so as to be pushed along the track. No inertia storing flywheel or other energy storing mechanism is required in the vehicle. Instead, a simple pull with both arms will shoot the vehicle forward, accelerating it faster and faster until it passes the end of the track.

BRIEF DESCRIPTION OF THE DRAWINGS

A detailed description of the invention is hereafter described with specific reference being made to the drawings in which:

FIG. 8 is a fragmentary bottom plan view thereof with parts cut away;

FIG. 9 is a fragmentary perspective detail thereof showing the front of the catapult track;

FIG. 10 is a fragmentary perspective detail thereof showing the catapult track hinged;

DESCRIPTION OF THE PREFERRED EMBODIMENTS

Figures 1, 11, 12:
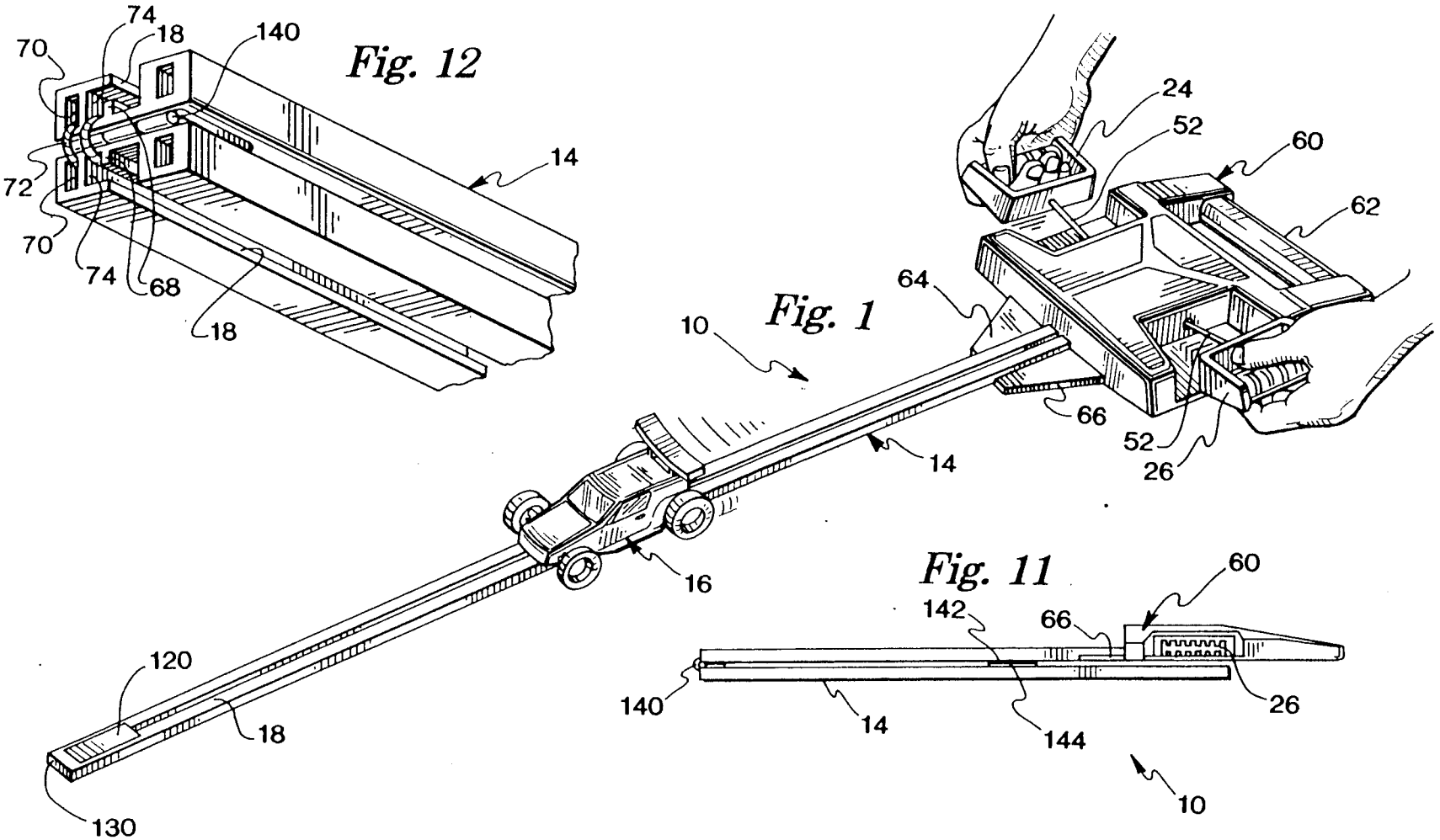
FIG. 1 is a perspective view of the invention.
FIG. 11 is a left side elevational view thereof showing the catapult track hinged and fastened by hook and mesh tabs.
FIG. 12 is a fragmentary perspective detail view thereof showing the hinged track.
Figure 2:
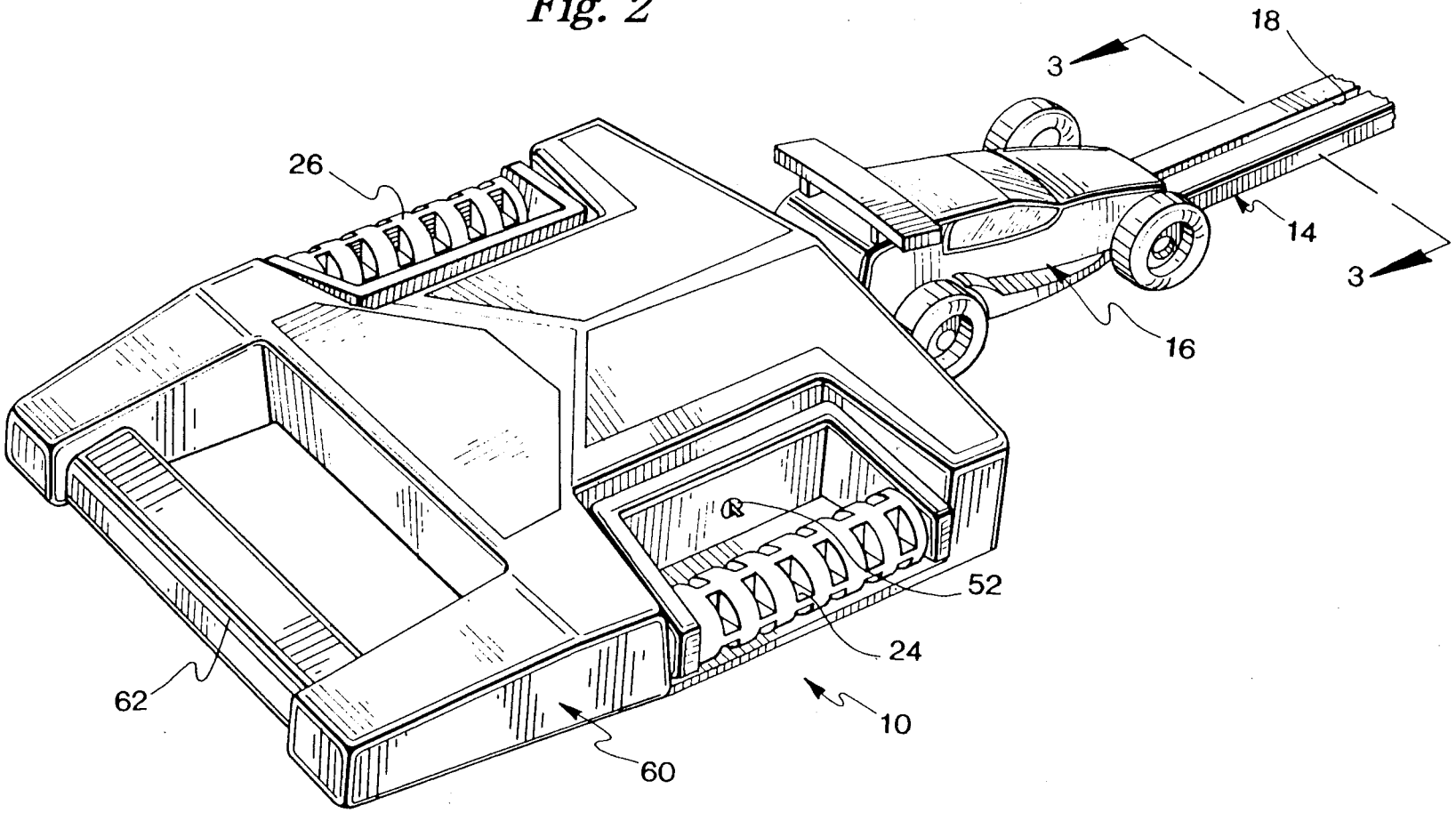
FIG. 2 is a fragmentary view of the invention of FIG. 1.

With reference to the Figures it will be seen that toy car launcher 10 includes a main housing 12 and an elongated launcher track 14. A car 16 is shown placed in a slot 18 within track 14. Car 16 includes a downwardly projecting hook 20 (see FIG. 4) which may engage a slide mechanism or shuttle 22. A pair of handles 24, 26 are connected to a mechanism within main housing 12 which cause shuttle 22 to rapidly move down track 14 causing car 16 to rapidly accelerate until it releases from the track end.

Figure 7:
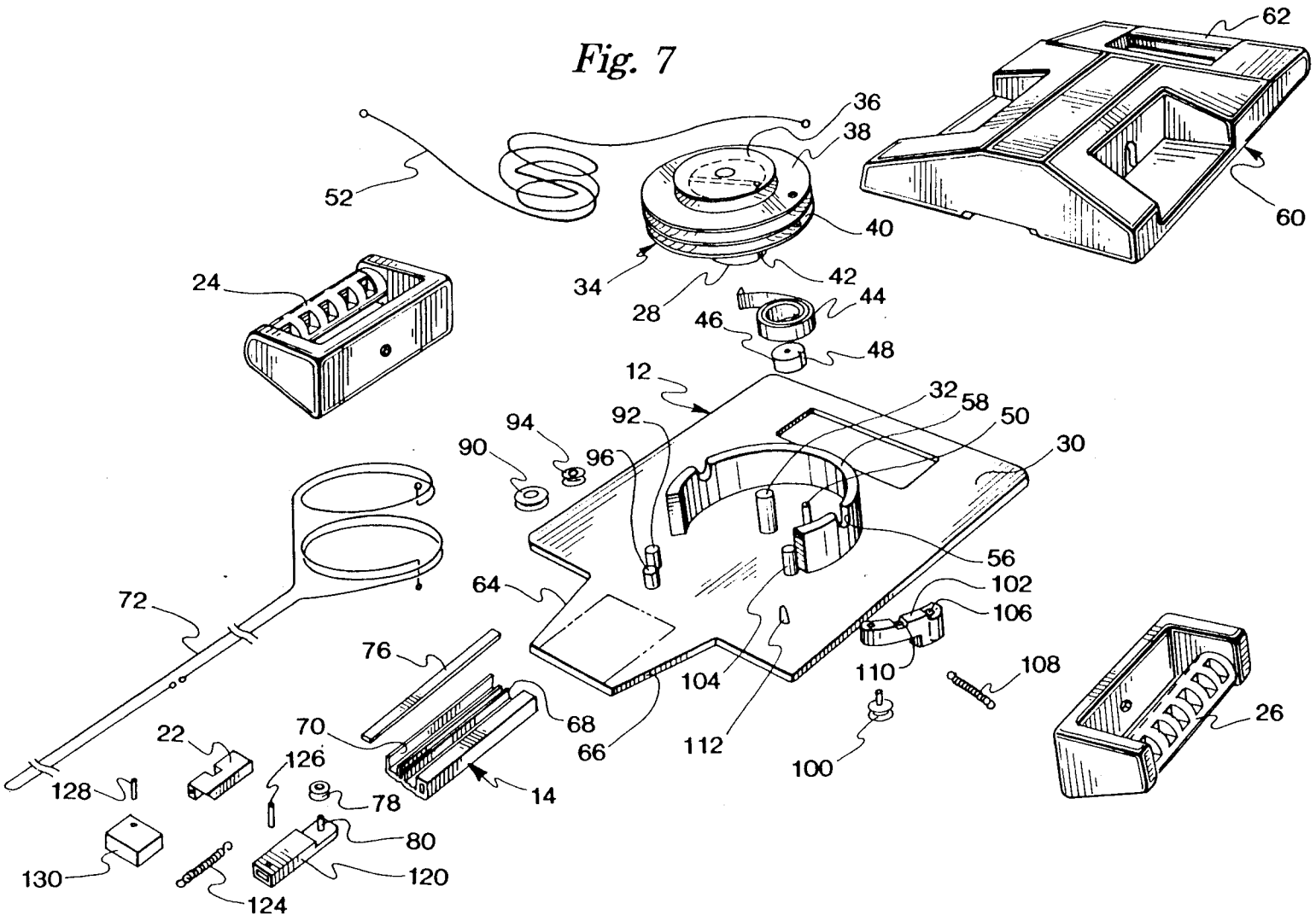
FIG. 7 is an exploded view thereof with some parts omitted.

With reference to FIG. 7 it will be seen that main housing 12 includes a base 30 which includes a central spool axle 32 to hold a windlass spool 34 which includes a drive pulley or windlass power sheave 36, a launch reel or sheave 38 and a takeup reel or return sheave 40. Windlass spool 34 includes a lower whipping spool 28 having a spring slot 42 in which an end of a whipping spring 44 is fitted. The other end of whipping spring 44 is held in engagement to a mother spool 46 having a spring slot 48 which secures the other end of the spring. The mother spool 46 is placed over mother axle 50 as shown in FIG. 8. The whipping spring 44 thus described is often referred to as a winding roller spring, rewinding clock spring or self-retracting whip spring. It is a form of a torsion spring that allows the windlass spool 34 to rewind.

A pull or windlass line 52 is placed over windlass power sheave 36 as shown and feeds to handles 24, 26 to which each end is attached. As will be seen in FIG. 7, the line 52 includes a right hand wind and a left hand wind such that an outward pull on both handles causes the windlass spool 34 to rapidly rotate. The lines pass over guide slots 54, 56 in shroud 58 of the base 30. The entire mechanism is encased in a cover 60 designed to include a carrying handle 62.

An elongated track 14 is secured to base 30 and may be strengthened by a pair of gussets 64, 66. As shown in FIGS. 3,7,9 and 12, track 14 includes a longitudinal slot 18 in which a guide rib 68 is positioned. Track 14 includes an elongated opening 70 through which the return end of a drive line 72 may extend as shown. Guide rib 68 defines an elongated slot 74 through which the launch end of drive line 72 is guided. Opening 70 is closed by a cover strip 76 as shown in FIG. 7. Drive line 72 is attached to and wound about launch sheave 38 and passes through elongated slot 74 turns about a primary tension sheave 78 rotatably mounted about a spindle 80. The line continues back towards main housing 12 through elongated opening 70. It then passes around return sheave 40.

Figure 5:
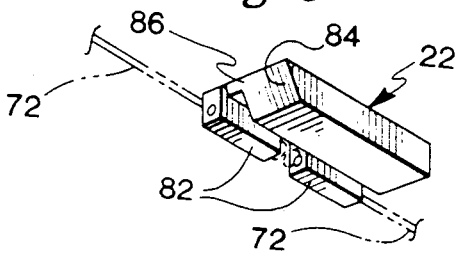
FIG. 5 is a detail perspective view thereof showing the catapult shuttle from the front, side and below.
Figure 6:
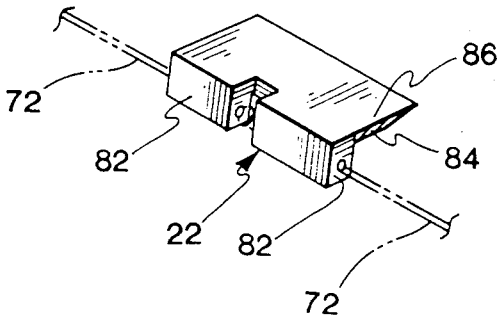
FIG. 6 is a detail view thereof showing the subject of FIG. 5 from the opposite side and above.

It will be readily seen that rotation of windlass spool 34 by pulling said handles 24 and 26 causes said drive line 72 to unwind from return sheave 40 and wind on launch sheave 38. Shuttle 22 as shown in FIGS. 5, 6 and 9 is attached to drive line 72 and is captively held within slot 18. Shuttle 22 includes a binding 82 which is guided within opening 74 and includes a receiver 84 which has a knife edge 86 which catches and engages against hook 20 of car 16. As drive line 72 is moved along the track, the shuttle moves. This causes the car in the track to accelerate with the movement of the line.

Referring to FIGS. 7 and 8, drive line 72 is kept taut at all times to avoid fouling the line. A return idler sheave 90 fits over axle 92 and deflects the return leg of drive line 72. A launch idler sheave 94 about axle 96 deflects the launch leg of the drive line. A secondary tension mechanism is employed within main housing 12 to keep tension on the drive line. Line passing from the launch idler sheave 94 passes about secondary tension sheave 100. Sheave 100 is carried at an end of a secondary tension arm 102 which is pivotally mounted to a secondary tension arm pivot 104 through hole 106. A spring 108 is connected between a post 110 on arm 102 and a post 112 on base 30. It will readily be seen that spring 108 functions to increase the travel distance of drive line 72 which effectively keeps the line taut at all times.

With reference to FIGS. 1 and 7, the remote end of track 14 includes a primary tension mechanism. That mechanism includes a primary tensioner block 120 held within the track for movement longitudinally. It includes a spindle 80 to which sheave 78 may rotate. Block 120 is connected to a primary tension spring 124 by pin 126. The other end of spring 124 is attached by pin 128 to a rigidly attached bulkhead 130. In this manner, the spring causes the line 72 to be tensioned.

This tension is particularly important if the track 14 includes one or more hinges 140 to make the device 10 shorter in length for storage and transportation. Hinge 140 as shown in FIGS. 10–12 allows the track to fold back upon its self, thereby decreasing the length of the toy when it is to be carried by the handle 62. As shown, the track is simply broken into two portions and hinged together by hinge 140. Since the bending back of the track increases the distance that drive line 72 must travel, spring 124 is pulled and relieves the tension that would be applied to the line 72. When folded back, the track sections may be temporarily held together by a hook 142 and loop 144 combination such as with Velcro® brand fastener pads as shown in FIG. 11.

Preferably, car 16 includes a downwardly projecting hook 20 which passes into slot 18 of track 14 to abut against knife edge 86 of shuttle 22. In this manner, the device 10 can be used only to launch the toy car or some other object especially built to include a hook. Otherwise, the launcher 10 could include an upward projection from shuttle 22 such that anything positioned on top of track 14 against the upward projection could be launched. The hook 20 is a safety feature. The invention is not limited to devices which require a hook as the shuttle but could include a protection as described which could engage an object outside of slot 18. If desired, the device can be easily modified to allow its use as an airplane launcher.

Figure 3:
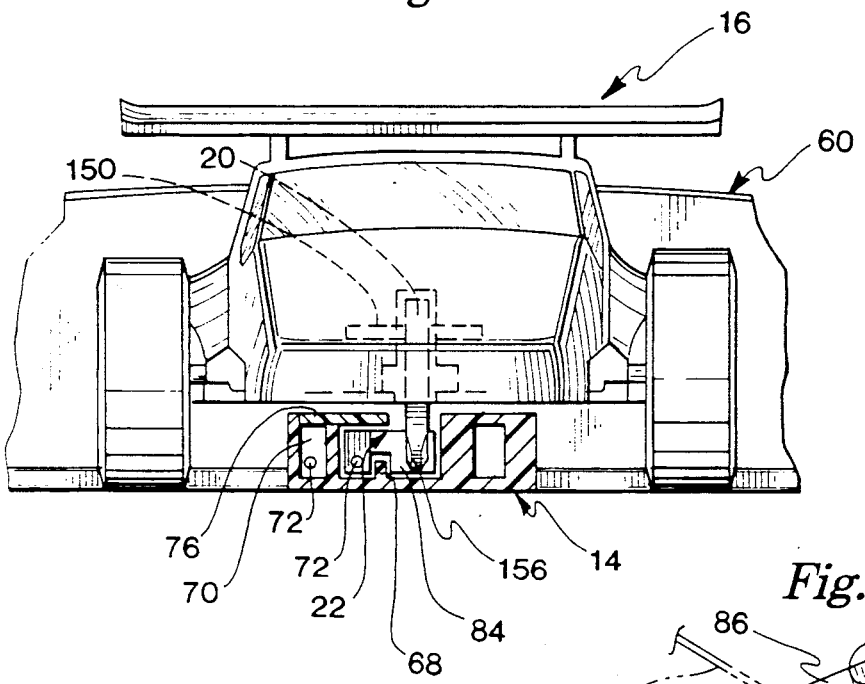
FIG. 3 is a sectional elevation thereof taken along line 3—3 in FIG. 2.
Figure 4:
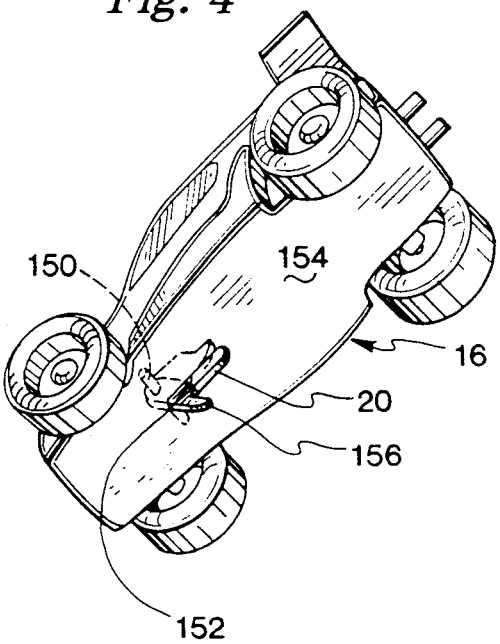
FIG. 4 is a perspective view of the bottom of the toy car portion thereof.

With reference to FIGS. 3 and 4, car 16 preferably includes a hook 20 hinged to the car body such that the hook can swing up into the car body as it hits the primary tensioner block 120. This eases the transition of the vehicle's travel from the track to a floor. In this case, car 16 may include a hook 20 mounted to the body by trunion pins 150 which allow the hook to swing up into slot 152 in the base 154 of the car 16. The hook tip 156 is thus completely hidden within the car as it encounters resistance. It has been found that a car should have high friction rear wheels and lower friction front wheels to make the car run straighter. Although the application refers to cars, it is intended to cover the launching of any object desired and is not limited to four wheeled vehicles.

The swinging hook 20 also provides a safety feature in that the hook cannot engage with shuttle 22 if the track 14 is not reasonably level. If the track is lifted to point the end of the track into the air, the hook will slide into slot 152 so the vehicle 16 cannot be shot into the air.

In the Figures it will be seen that the diameter of drive pulley 36 is substantially less than the diameters of launch and return sheaves 38, 40. This increases the speed of the car on the launcher. A smaller diameter for the drive pulley 36 than the launch and return sheaves 38, 40 causes the drive line 72 to travel faster than the line pulled by handles 24 and 26.

OPERATION

In operation, a user would unfold the track 14 and lay the launcher 10 on the floor. The user can then kneel on the cover 60 adjacent the handle 62 and pulls rapidly outward on one or both handles 24, 26. The handle throw distance is typically on the order of about six inches and the extended track may be about two to three feet in length. The dimensions are not critical. The dimensions only affect how fast a car may be propelled. A smaller car will be projected faster and has the illusion of greater speed.

As the handles are pulled, line 52 is pulled out causing the windlass spool 34 to rotate. As it rotates, the drive line on the return sheave is rapidly unwound while the launch sheave rapidly winds up the drive line. The shuttle attached to the line 72 is pulled down the length of the slot 18. A car placed ahead of the shuttle 22 with its hook tip 156 against the knife edge 86 will be rapidly pushed down the track, gaining speed along the entire track. When the car reaches the block 120, the hook disengages to swing up away from bulkhead 130 and the car shoots past the launcher down the floor. It has been found that a car may be propelled in excess of 40 feet by the launcher.

All the while the drive line is unwinding and winding on the sheaves 40, 38, the various tensioning aids are maintaining equal tension on the line such that it is not twisted or fouled. When the handles 24, 26 are released, the rewind mechanism including the whipping spring 44 causes the windlass spool 34 to rotate counterclockwise, rewinding the windlass line 52 and drawing the shuttle 22 back to a ready position. When done, the user simply lifts the device up, and folds the track 14 back so the sections are held by the hook and loop combination. The device may be carried by handle 62.

It is readily apparent that the simple application of muscle power to handles 24, 26 causes the car on the track to be launched from the track 14 with great speed. Lower speeds are easily attained by simply pulling outwardly on the handles more slowly. Although a design with two handles is optimal, it should be apparent that only one handle is necessary, such that a user with only a single arm can operate the toy.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto

What is claimed is:

1. A toy vehicle launcher for launching vehicles comprising:

(a) main housing carrying a drive pulley, said drive pulley being connected by a pull line to at least one handle, which when pulled causes said pulley to rotate;

(b) an elongated track member having two ends, one of said ends being attached to said main housing, said track member including an end pulley at the other of said ends;

(c) said main housing further carrying a takeup reel and a launch reel, each of said reels operatively connected to said drive pulley so as to rotate when said drive pulley rotates;

(d) a drive line having one end attached to said takeup reel and another end attached to said launch reel such that rotation of the reels causes the line to wind on one reel and unwind on the other reel, said drive line being fed along the length of said track and positioned over said end pulley; and (e) a slide mechanism attached to said drive line such that said slide mechanism may move along said track between said main housing and said end pulley when said reels are rotated due to rotation of said drive pulley, said track being constructed and arranged to define an elongated slot in which said slide mechanism travels, said slot allowing entry of a hook from a vehicle placed on said track such that movement of said slide mechanism will engage a vehicle hook to propel said vehicle along said track.

2. The toy vehicle launcher of claim 1 wherein said drive pulley is connected by said pull line to two opposing handles which when pulled outwardly cause said drive pulley to rapidly rotate

3. The toy vehicle launcher of claim 1 wherein the diameter of said drive pulley is substantially less than the diameter of said takeup and launch reels such that the outer edge of said reels may rotate faster than the outer edge of said drive pulley.

4. The toy vehicle launcher of claim 1 wherein said drive pulley, launch reel and takeup reel are journalled for rotation about a common pivot point.

5. The toy vehicle launcher of claim 1 wherein said track includes at least one hinge point at which said track may be folded back upon itself to decrease the track length during transportation of said launcher.

6. The toy vehicle launcher of claim 1 wherein said end pulley is connected to a spring means for allowing said drive line to remain uniformly taut when said track is folded about said hinge and when unfolded.

7. The toy vehicle launcher of claim 1 wherein said main housing carries at least one spring-tensioned idler pulley over which said drive line passes to keep said line taut at all times.

8. The toy vehicle launcher of claim 1 further including spring means connected between said housing and said drive pulley for rewinding said pull line and drive line to a starting position.

9. A toy vehicle launcher for launching vehicles comprising:

(a) main housing carrying a drive pulley, said drive pulley being connected by a pull line to at least one handle, said pull line being wound about said drive pulley, which when a handle is pulled unwinds causing said pulley to rotate;

(b) an elongated track member having two ends, one of said ends being attached to said main housing, said track member including an end pulley at the other of said ends;

(c) said main housing further carrying a takeup reel and a launch reel, each of said reels operatively connected to said drive pulley so as to rotate when said drive pulley rotates;

(d) a drive line having one end attached to said takeup reel and another end attached to said launch reel such that rotation of the reels causes the line to wind on one reel and unwind on the other reel, said drive line being fed along the length of said track and positioned over said end pulley; and (e) a slide mechanism attached to said drive line such that said slide mechanism may move along said track between said main housing and said end pulley when said reels are rotated due to rotation of said drive pulley, said slide mechanism being constructed and arranged such that a vehicle placed on said slide mechanism will be pushed ahead of said slide mechanism as said slide mechanism moves along said track.

10. The toy vehicle launcher of claim 9 wherein said track is constructed and arranged to define an elongated slot in which said slide mechanism travels, said slot allowing entry of a hook from a vehicle placed on said track such that movement of said slide mechanism will engage a vehicle hook to propel said vehicle along said track.

11. The toy vehicle launcher of claim 9 further including spring means connected between said housing and said drive pulley for rewinding said pull line and drive line to a starting position.

12. The toy vehicle launcher of claim 9 wherein said drive pulley is connected by said pull line to two opposing handles which when pulled outwardly cause said drive pulley to rapidly rotate.

13. The toy vehicle launcher of claim 9 wherein the diameter of said drive pulley is substantially less than the diameter of said takeup and launch reels such that the outer edge of said reels may rotate faster than the outer edge of said drive pulley.

14. The toy vehicle launcher of claim 9 wherein said drive pulley, launch reel and takeup reel are journalled for rotation about a common pivot point.

15. The toy vehicle launcher of claim 9 wherein said track includes at least one hinge point at which said track may be folded back upon itself to decrease the track length during transportation of said launcher.

16. The toy vehicle launcher of claim 9 wherein said end pulley is connected to a spring means for allowing said drive line to remain uniformly taut when said track is folded about said hinge and when unfolded.

17. The toy vehicle launcher of claim 9 wherein said main housing carries at least one spring-tensioned idler pulley over which said drive line passes to keep said line taut at all times.

* * * * *